US007671292B2

(12) United States Patent
Suter et al.

(10) Patent No.: US 7,671,292 B2
(45) Date of Patent: Mar. 2, 2010

(54) COMPACT OPERATING MECHANISM FOR MEDIUM AND HIGH VOLTAGE SWITCHGEAR

(75) Inventors: Ernst Suter, Kölliken (CH); Xavier Allaire, Chassieu (FR); Philippe Manin, Lyons (FR)

(73) Assignee: Areva T&D AG, Oberentfelden (CH)

( * ) Notice: Subject to any disclaimer, the term of this patent is extended or adjusted under 35 U.S.C. 154(b) by 0 days.

(21) Appl. No.: 12/334,417

(22) Filed: Dec. 12, 2008

(65) Prior Publication Data

US 2009/0173611 A1 Jul. 9, 2009

(30) Foreign Application Priority Data

Dec. 17, 2007 (FR) ..... 07 59902

(51) Int. Cl.
*H01H 5/00* (2006.01)

(52) U.S. Cl. ..... 200/400

(58) Field of Classification Search ..... 200/400, 200/401, 500, 501

See application file for complete search history.

(56) References Cited

U.S. PATENT DOCUMENTS

| | | | | |
|---|---|---|---|---|
| 4,821,008 | A * | 4/1989 | Micoud et al. | 335/189 |
| 5,280,258 | A * | 1/1994 | Opperthauser | 335/172 |
| 5,571,255 | A * | 11/1996 | Baginski et al. | 200/401 |
| 5,595,287 | A | 1/1997 | Niklaus | |
| 5,901,838 | A * | 5/1999 | Nakatani et al. | 200/400 |
| 5,931,290 | A * | 8/1999 | Wehrli et al. | 200/400 |
| 6,232,569 | B1 * | 5/2001 | Nakajima et al. | 200/400 |
| 6,437,269 | B1 * | 8/2002 | Rakus | 200/400 |
| 6,472,627 | B1 * | 10/2002 | Yoon | 200/400 |
| 6,563,067 | B2 * | 5/2003 | Ohtsuka et al. | 200/400 |
| 6,809,279 | B2 | 10/2004 | Allmen | |
| 6,967,302 | B2 | 11/2005 | Peter | |
| 7,319,203 | B1 * | 1/2008 | Briggs et al. | 200/400 |
| 7,368,677 | B2 * | 5/2008 | Jones et al. | 200/400 |
| 7,449,653 | B2 * | 11/2008 | Gibson et al. | 200/400 |

FOREIGN PATENT DOCUMENTS

| | | | |
|---|---|---|---|
| EP | 0294561 | A2 | 12/1988 |
| EP | 0651409 | A1 | 3/1995 |
| EP | 1130610 | A1 | 9/2001 |
| EP | 1178505 | A1 | 2/2002 |
| EP | 1369886 | A1 | 12/2003 |
| EP | 1408522 | A1 | 4/2004 |

OTHER PUBLICATIONS

INPI (Institut National de la Propriete Industrielle) Rapport de Recherche Preliminaire, 31 Juillet 2008 [International Search Report, Jul. 31, 2008.

* cited by examiner

*Primary Examiner*—Michael A Friedhofer
(74) *Attorney, Agent, or Firm*—Nixon Peabody LLP

(57) ABSTRACT

Operating mechanism for medium and high voltage switchgear, in which a rotatable main shaft is coupled to a switch, and a rocker plate is rotatable with the main shaft, the main shaft being arranged to open and close said switch by tilting the rocker plate. The rocker plate constitutes a plurality of force transmission levers and comprises a plurality of zones distributed around the main shaft. A rotary actuator has force transmitting means for driving the rocker plate in a direction corresponding to closing of the switch, and an opening spring for driving the rocker plate in a direction corresponding to opening of the switch. Closed switch locking means are coupled to the rocker plate (4) and are disposed substantially in a common plane of the rocker plate.

21 Claims, 17 Drawing Sheets

COMPACT OPERATING MECHANISM FOR MEDIUM AND HIGH VOLTAGE SWITCHGEAR

CROSS REFERENCE TO RELATED APPLICATIONS OR PRIORITY CLAIM

This application claims priority to French Patent Application No. 07 59902, filed Dec. 17, 2007.

DESCRIPTION

Technical Field and Prior Art

The present invention relates to mechanical operating mechanisms for medium and high voltage switchgear.

Such mechanical operating mechanisms are known, for example, from the document EP 0 651 409 and the document EP 1 178 505.

These operating mechanisms include a plurality of levers that are arranged to be set in rotation by means of energy stored in springs, for the purpose of opening and closing a switch.

In particular, one lever is arranged to transmit a closing force to the switch, one lever to transmit an opening force to the switch, one lever to act directly on the switch, one lever to lock the switch in its closed position, and one lever to provide damping for the operating mechanism during an operation of closing the switch. That operating mechanism is of a very large size, its manufacture is complex, and its selling cost high.

In addition, the various forces are transmitted through shafts that are subject to severe applied torsion and bending forces.

A mechanical operating mechanism for a circuit breaker is also known from the document EP 0 294 561, and includes a rocker plate that is rotatable on a first torsion bar, in contact with a cam that is driven by a second torsion bar in order to cause the circuit breaker to be closed, with closing of the circuit breaker causing energy to be stored in the first torsion bar for the purpose of opening the circuit breaker, the rocker plate being also coupled to locking means and damping means.

That operating mechanism makes use of a torsion bar for closing the switch, considerably increasing the size of the operating mechanism, and the transmission of force from the torsion bar to the cam makes a complex end product necessary.

Moreover, the operating mechanism is coupled to the switch in such a way that both the operating mechanism and the switch are subjected to additional transverse stresses that give rise to the risk of reducing the useful life both of the switch and of the operating mechanism.

It is therefore an object of the present invention to offer a mechanical operating mechanism for high and medium voltage switchgear, which is of simple, compact construction and has a reduced number of component parts and a reduced cost by comparison with operating mechanisms in the current state of the art.

Discussion of the Invention

The object stated above is achieved by an operating mechanism, for opening and closing a switch, that includes a rocker plate rotatably mounted on a mounting plate by means of a main shaft, means for opening and closing the switch, and means for locking the switch in its closed position, the rocker plate, the switch opening and closing means, and the closed switch locking means all being arranged in substantially the same plane, the switch being coupled to the main shaft. The number of components is reduced, so that the operating mechanism is made more compact, with a reduced cost. In addition, some of the forces involved are transmitted through the rocker plate and applied in the plane of the rocker plate instead of through the shaft, so that the shaft is subjected to less stress.

In one particularly advantageous embodiment of the invention, the switch closing means comprise a cam that cooperates with the rocker plate in such a way as to tilt the rocker plate, whereby to cause the switch to be closed. This cam is arranged to rotate with a drive wheel, which is itself driven by a spring, this spring being fixed partly to the drive wheel and partly to the mounting plate, the arrangement being such that the spring overlies the rocker plate. This makes the operating mechanism even more compact.

The operating mechanism accordingly makes use of a rocker plate that acts as a lever for performing several different functions, and this enables the dimensions, especially the depth, of the operating mechanism to be reduced. This in turn enables the closing spring to be disposed in a plane parallel to the plane of the lever, so that the closing spring is positioned over the lever. In effect several levers are grouped together in a single rocker plate, and this, together with the particular arrangement of the closing spring, enables a particularly compact operating mechanism to be achieved.

A particular embodiment of the invention puts the storage of the mechanical energy required for opening, and the systems for holding and releasing this opening energy, all in one common plane.

The main shaft includes for example a switch operating lever that is coupled in rotation to the main shaft and that is coupled to the movable contact of the switch.

According to the present invention, there is provided an operating mechanism for a switch in medium or high voltage switchgear, including a rocker plate fixed on a main shaft that is mounted for rotation on at least one first mounting plate, the said main shaft being orthogonal to the first mounting plate, and the rocker plate being orthogonal to the main shaft, the main shaft being coupled to the switch, whereby opening and closing of the switch are caused to take place by rotation of the main shaft, the main shaft being adapted to be rotated by tilting movement of the said rocker plate, and the said operating mechanism further including:

- a rotary closing actuator with a force transmitting means, for closing the switch;
- an opening actuator for opening the switch; and
- closed switch locking means for locking the switch in a closed state, the said locking means being adapted to apply to the rocker plate a locking force to lock the rocker plate when the switch is in its closed state;

the said rocker plate being linked to the opening actuator, the rotary closing actuator being adapted to make contact with the rocker plate whereby to cause the rocker plate to pivot in a direction corresponding to closing of the switch, and the closed switch locking means being adapted to make contact with the rocker plate whereby to hold the switch closed; and the rocker plate, the opening actuator, the force transmitting means of the closing actuator, and the closed switch locking means being so disposed that the forces applied by the opening actuator, the force transmitting means of the closing actuator, and the closed switch locking means are all substantially in one plane of the rocker plate, referred to as the first plane.

The force transmitting means may consist of a cam that is fixed on, and rotatable with, a closing shaft parallel to the main shaft, the cam being adapted to make contact with a second zone of the rocker plate, whereby to apply a tilting force, in a first direction of rotation, to the rocker plate fixed to the main shaft so as to cause the switch to close, the said cam being rotatable with a drive disk that is adapted to be driven in rotation by elastic energy storage means comprising a closing spring, the said closing spring being disposed in a second plane that is substantially parallel to the first plane, and the said closing spring being rotatably mounted at a first end thereof on the first mounting plate, and, at a second end of the spring, on the drive disk.

The operating mechanism may further include means for loading the closing spring, the said means comprising means for causing the drive disk to rotate in the same direction as that of the rotation that is caused to occur by release of stored energy from the closing spring. The means for loading the closing spring comprise, for example, a train of toothed wheels driven by an electric motor, with one said toothed wheel meshing with teeth on the periphery of the drive disk.

In addition, the operating mechanism preferably further includes open switch locking means adapted to exert a force holding the drive disk stationary when the closing spring is in a loaded state.

The drive disk, the toothed wheel meshing with the drive disk, and the open switch locking means are preferably disposed substantially in a common third plane parallel to the first plane, which leads to a reduction in the depth of the operating mechanism.

The closing spring preferably overlies the rocker plate, which leads to a reduction in the overall size of the operating mechanism.

The opening actuator includes, for example, an opening spring that is adapted to urge the rocker plate in a second direction of rotation opposed to the first direction of rotation, whereby to cause the said switch to be opened, the opening spring being mounted on the same face of the first mounting plate as the rocker plate, the closing spring being disposed on another face of the first mounting plate, the opening spring having a first end rotatably mounted on the first mounting plate, on the same side of the mounting plate as the first end of the closing spring relative to the rocker plate, and the opening spring further having a second end rotatably mounted on the rocker plate.

The closing spring preferably crosses over the opening spring, which makes the operating mechanism even more compact.

The closing shaft lies on the opposite side, relative to an axis that is substantially parallel to the axis of the opening spring, and that intersects the main shaft, from the opening spring.

For example, the closing spring and the opening spring are helical tension springs.

The axis of the opening spring defines an angle of about 45° relative to a horizontal direction, which makes it possible to position the operating mechanism either horizontally or vertically.

The operating mechanism further may include means for damping the rotation of the rocker plate caused by the opening spring. Preferably, the damping means are disposed inside the opening spring, which enables the overall size to be reduced.

The closed switch locking means cooperate with an operating lever which is rotatably mounted on the rocker plate.

The operating mechanism may, accordingly, further include braking means for arresting the means for loading the closing spring when the required amount of load of the closing spring is reached, the said braking means comprising a wheel fixed relative to the drive disk for rotation therewith, the said wheel having a notch in its perimeter, the said notch being adapted to cooperate with de-activating means consisting of a mechanism for de-activating the said loading means, and the said notch being so oriented circumferentially relative to the drive disk that it corresponds to the rotation of the drive disk that itself corresponds to the required amount of load.

The said de-activating means comprise, for example, an interrupter adapted to interrupt the power supply to the said motor.

The operating mechanism may further include isolating means for isolating the means for loading the closing spring from the drive disk once the drive disk has reached a top dead center point corresponding to the required amount of load of the closing spring, the said isolating means consisting of at least one radially retractable tooth of the drive disk.

The closed switch and open switch locking means are, for example, disposed on the opposite side of the closing spring from the main shaft.

In a preferred example, the operating mechanism further includes manual actuating means adapted to release, alternately, the open switch locking means and the closed switch locking means, so as to enable the switch to be closed and opened respectively, which affords a single device that will unlock the operating mechanism in both its switch closing and opening modes, so enabling the overall size and production cost of the operating mechanism to be reduced.

The manual actuating means may comprise an actuating lever rotatably mounted on the first mounting plate and disposed between the closed switch locking means and the open switch locking means. The actuating lever may be adapted to be operated at a first end thereof, and is arranged to make contact through an end of the actuating lever with a lever of the open switch locking means, and through another end of the actuating lever with a lever of the closed switch locking means, so as to cause the said levers to tilt, whereby to release switch closing energy and switch opening energy respectively.

In one embodiment, the actuating lever may consist of a first portion and a second portion, the first portion including a second end, which is the end for cooperation with the said lever for de-activating the open switch locking means, and the second portion including a radial projecting element which is the end for cooperation with the said lever for de-activating the closed switch locking means.

The closed switch locking means and the open switch locking means are, for example, mounted on either side of the first mounting plate.

The train of toothed wheels in the means for loading the closing spring is preferably disposed on the opposite side of the closing spring from the main shaft, being closer to the closing shaft than the manual actuating means.

The operating mechanism may with advantage further include status indicating means for indicating the prevailing state of the switch, the said status indicating means being disposed on the same side of the closing spring as the main shaft. The said status indicating means may for example consist of position indicating interrupters, a visual position indicator, and stop means for blocking a lever, the open switch locking means, position indicating interrupters, visual position indicator, and stop means all being coupled to the rocker plate by means of connecting rods.

The operating mechanism preferably further includes a second mounting plate parallel to the first mounting plate, the rocker plate being disposed in a space between the two mounting plates, and the main shaft projects from a face of at least one of the mounting plates, outside the space between the two said plates.

For example, the rocker plate is disposed in at least two parallel planes, and the rocker plate may then consist of a plurality of levers fixed together to form a mechanical assembly.

The present invention also provides medium and high voltage switchgear including a switch having a contact movable in a straight line and a fixed pole, and further including an operating mechanism of the present invention.

The switch may include a shaft rotatable about its axis and a switch actuating lever rotatable with the said shaft, the switch actuating lever being coupled to the said movable contact in such a way that a rotational movement of the said shaft about its axis causes the said movable contact to be displaced in a straight line, and the main shaft and the shaft of the switch are on the same axis as other and rotatable together.

In another version, a switch actuating lever is rotatable with the main shaft and fixed to the main shaft where the main shaft projects from one of the mounting plates, the switch actuating lever being coupled to the movable contact.

In yet another version, the switchgear of the invention includes a rod system for coupling the switch actuating lever to the movable contact of the switch.

The switch actuating lever is for example coupled to the movable contact by means of a movable member displaceable in straight line motion. Either the switch actuating lever has an oblong slot in which one end of an element rigidly coupled to the movable pole of the switch is arranged to be loosely mounted, or the switch actuating lever includes a toothed angular sector adapted to mesh with a toothed portion that is rigidly coupled to the movable pole of the switch.

BRIEF DESCRIPTION OF THE DRAWINGS

The present invention can be understood more clearly on a reading of the following description and the attached drawings, in which.

DETAILED DESCRIPTION OF PARTICULAR EMBODIMENTS

Figure 1A:
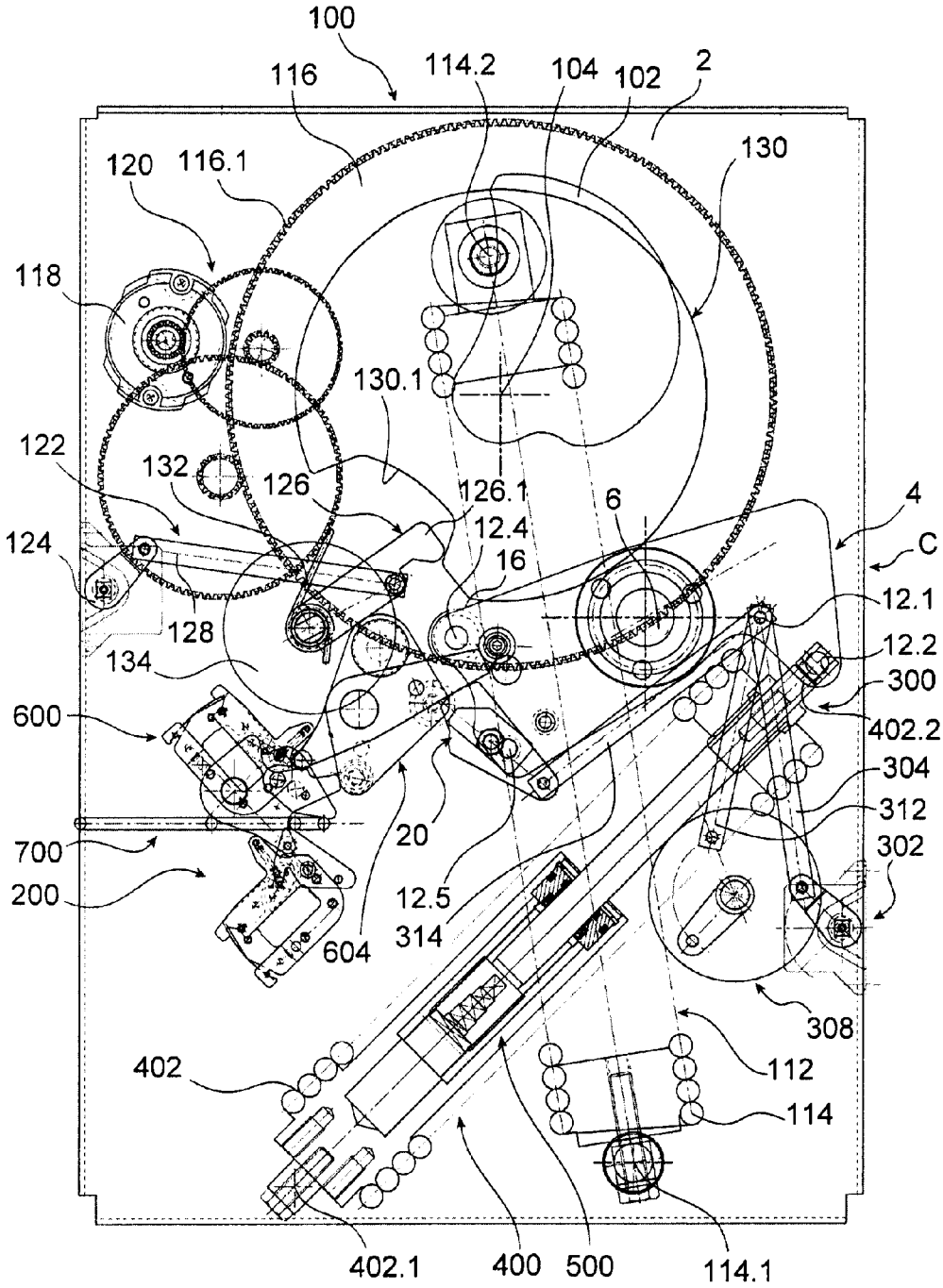
FIG. 1A is a front view of one embodiment of an operating mechanism of the present invention.

Throughout this description, the height of the operating mechanism is defined as being the dimension in the vertical direction in FIG. 1A; its width is the dimension in the horizontal direction; and its thickness is the dimension along an axis at right angles to the plane of the paper in FIG. 1A.

FIG. 1A shows, by way of example, one embodiment of a mechanical operating mechanism C for a switch, in particular a circuit breaker, of the present invention.

This operating mechanism has two mounting plates 2, only one of which can be seen in FIG. 1A, between which a rocker plate 4 is rotatably mounted by means of a main shaft 6. The rocker plate 4 is disposed substantially parallel to the mounting plates 2.

The main shaft 6 is mounted in rolling bearings, for rotation between the two parallel mounting plates. In the description below, reference is made generally to only one mounting plate 2, in the interests of simplicity.

The rocker plate 4 is designed to transmit forces between various actuators and a switch (not shown).

The main shaft 6 extends through the rocker plate 4 substantially in a central portion of the rocker plate, to which it is fixed, for rotation together, by means of splines in the example shown. Other types of coupling between the shaft 6 and rocker plate 4 are possible, for example by the use of hexagonal profiles, since no torque is transmitted to the shaft 6. The main shaft 6 is arranged to be coupled to a switch, and in particular to a movable contact of the switch, so as to cause the switch to be opened or closed.

Figure 2A:
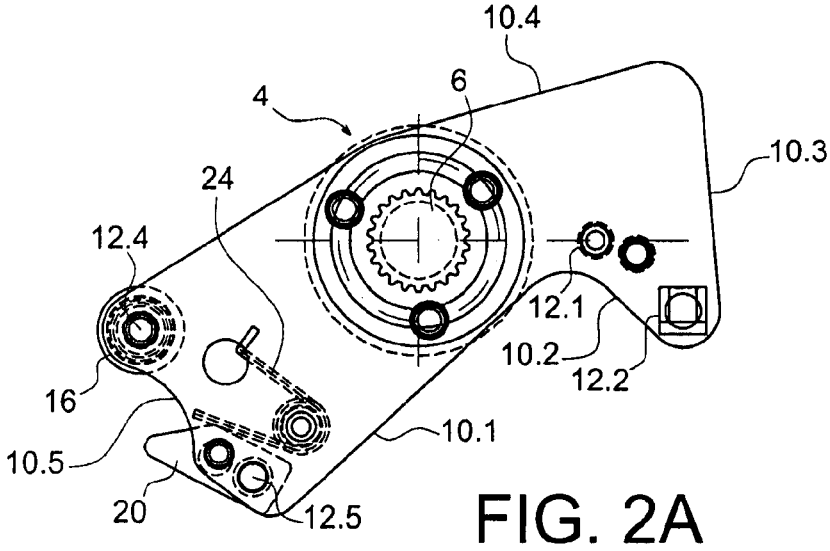
FIG. 2A is a front view of a rocker plate for the operating mechanism shown in FIG. 1, here shown by itself.

The rocker plate 4 is substantially in the form of a pentagon, the five sides of which are denoted 10.2, 10.3, 10.4, and 10.5. The two sides 10.1 and 10.2 make a concave (outward facing) angle 12.1 (see FIG. 2A).

Each of the corners 12.1, 12.2, 12.4, and 12.5 of the pentagon is joined to means adapted to exert a force on, or receive a force from, the rocker plate.

The corner 12.4 is designed to receive a force exerted by a rotary actuator for causing the rocker plate to tilt in the direction corresponding to closing of the switch. Below, this actuator is referred to as the closing actuator 100.

A roller 16, freely rotatable in the corner 12.4, is preferably provided, and is arranged to make contact with a rotary cam (which is described below), so leading to a reduction in friction forces.

The corner 12.5 comprises an operating lever 20 that is arranged to cooperate with a closed switch locking means of the rocking plate 4.

The corner 12.1 is linked to indicating means 300 for indicating various positions assumed by the switch.

The corner 12.2 is linked to an actuator that is designed to cause the rocker plate to tilt in a direction corresponding to opening of the switch. This actuator is referred to below as the opening actuator 400.

As to the corner 12.3, this is not connected to any control means in the example shown.

Rotation of the main shaft 6 is converted into straight line motion of the movable contact of the switch.

Figure 2B:
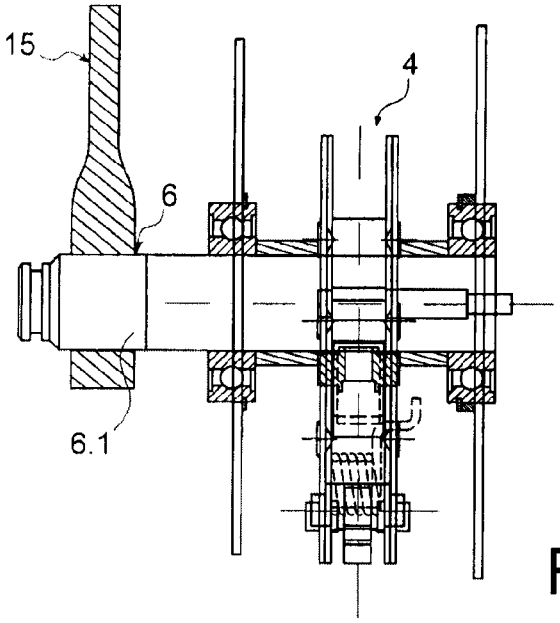
FIG. 2B is a side view of the rocker plate shown in FIG. 2A, here seen mounted in the operating mechanism.

In a first example of an embodiment, shown in FIG. 2B, the main shaft 6 has a first end portion 6.1, which projects out of the mounting plate 2, and on which a switch actuating lever 15 is fixed, for transmitting the force to the switch. The free end of the lever 15 may be coupled to the movable contact through a rod linkage, so that rotation of the main shaft 6 about its own axis causes the movable contact to move in straight line motion.

In another embodiment, the main shaft 6 is on the same axis as a control shaft of the switch. That example is described below.

In the example shown, the corners 12.2 and 12.4 are both at substantially the same distance from the main shaft 6. Other configurations are possible to obtain specific transmission ratios.

In addition, the corners 12.2 and 12.4 are substantially symmetrical relative to the main shaft 6. Careful selection of the angles, in particular, enables collisions between the various operating units (namely the rocker plate, springs, ratchet, and cam) to be avoided, and enables transmission ratios to be set.

The corner 12.1 is preferably concave, in order to avoid the occurrence of collisions between the rocker plate and opening spring.

In one embodiment, by way of example, the rocker plate 4 consists of two parallel plates 4.1 and 4.2, which can be seen in FIG. 2B and which are fixed in rotation to the main shaft 6, the said plates 4.1 and 4.2 being for example spaced apart by 20 millimeters (mm).

In the description below, the plane of the rocker plate means, for a rocker plate consisting of one sheet metal plate, the plane containing the rocker plate, where the rocker plate consists of a plurality of plates, for example two parallel plates 4.1 and 4.2 as in the example shown, any plane lying between the two plates and parallel to them.

The rocker plate may therefore be made in such a way that it is in effect contained in a plurality of parallel planes disposed close to each other. It can be arranged that the rocker plate is press-formed from sheet metal, or cast in a suitable alloy, or it may even be fabricated from a plurality of separate levers welded or screwed together, so that the resulting rocker plate consists of various levers lying in several parallel planes, which may for instance be 20 mm apart. This particular configuration, in several superimposed planes close to each other, does not give rise to any great applied force on the main shaft 6, so that it is not necessary to provide a shaft of large diameter to withstand high mechanical stresses. The operating mechanism of the invention does still offer a high degree of compactness both in height and in width.

When the two plates are 20 mm apart, the plane of the rocker plate means any plane that lies in this 20 mm gap and is parallel to the two plates 4.1 and 4.2.

Figure 3A:
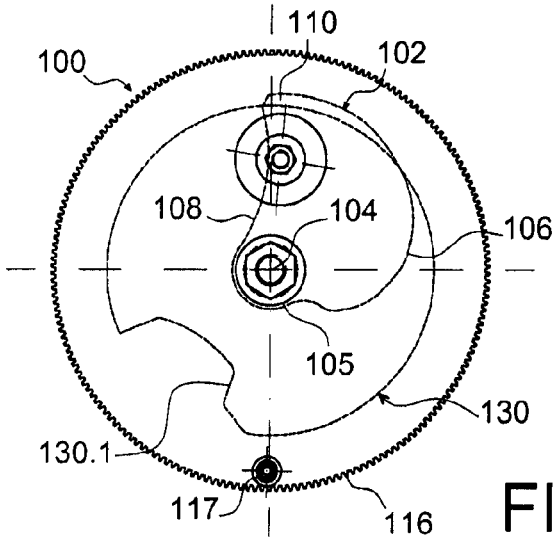
FIG. 3A is a front view showing switch closing drive means for the operating mechanism shown in FIG. 1, here shown by itself.
Figure 3B:
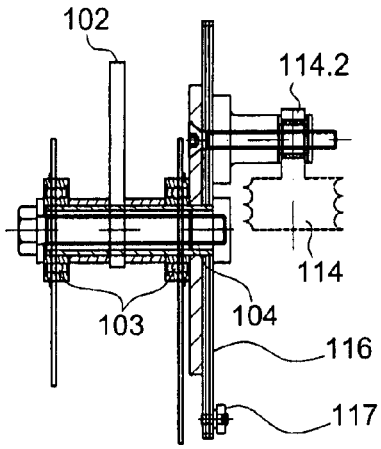
FIG. 3B is a side view of the drive means shown in FIG. 3A, here shown mounted on the operating mechanism.

The closing actuator 100, shown by itself, can be seen in FIGS. 3A and 3B.

The closing actuator comprises a cam 102 that is mounted rotatably on the mounting plate 2 by means of a shaft 104, referred to as the closing shaft, that is carried in rolling bearings 103.

The closing cam 102 is parallel to the mounting plate 2 and is substantially in the form of a crescent, fixed in rotation on the shaft 104 at a tip 105, which is where a portion 106 of larger curvature joins a portion 108 having a smaller curvature.

The closing cam 102 is arranged to make contact with the roller 18 carried by the rocker plate 4, on the zone of contact defined between the tip 105 and the tip 110 on the side of zone 106 of larger curvature.

The contact between the contact zone 106 and the roller 16 causes the rocker plate 4 to tilt in the closing direction of the contactor. In the example shown, this corresponds to anti-clockwise rotation of the rocker plate 4 about the main shaft 6.

The actuator 100 includes drive means 112 consisting of an elastic means, which in this example is a helical spring 114, referred to as the closing spring. The spring 114 is mounted at one of its ends, 114.1, in such a way as to be freely rotatable on the mounting plate 2, while its other end 114.2 is mounted on a drive disk 116, which is fixed to the closing cam 102, being again fully rotatable. The drive disk 116 is mounted on, and rotatable with, the shaft 104.

The closing spring 114 is a tension spring.

The spring 114, or more precisely its longitudinal axis, is disposed in a plane parallel to the plane of the rocker plate, which it overlies. The first end 114.1 fixed to the mounting plate 2 lies below the rocker plate 4, while the second end 114.2 fixed to the drive plate 116 lies above the rocker plate. Thus, the plane that contains the axis of the closing spring 114 is superimposed on the plane of the mounting plate 2. In this way the resulting operating mechanism has reduced transverse dimensions, especially its height and width. Moreover, the use of a single multi-function rocker plate is made possible, as is explained below in this description, so enabling the thickness of the operating mechanism to be reduced. The closing spring 114 is so disposed that the spring is to one side of the main shaft 6 and does not interfere with it.

The drive disk 116 is disposed above the rocker plate 4 in the drawings of the operating mechanism.

The closing spring 114 is disposed in such a way that it is positioned on a diameter of the drive disk 116, with its first end 114.1 being fixed on the mounting plate 2 opposite to the drive disk 116 relative to the rocker plate 4. The closing spring 114 extends over substantially the whole height of the operating mechanism in the version shown in FIG. 1A.

The closing spring 114 is designed to store elastic energy that, when the spring is released, drives the drive disk in clockwise rotation about the shaft 104, and also the closing cam 102.

The closing spring 114 is thus disposed within the operating mechanism in such a way that the release of elastic energy causes the drive disk 116 to rotate in the clockwise direction, so causing the switch to be closed.

Loading (or loading) of the closing spring 114 is effected by rotation of the drive disk 116 in the clockwise direction about the shaft 104, by means of an electric motor 118 that drives a gear train 120, consisting of toothed wheels one of which is in mesh with a tooth perimeter 116.1 of the drive disk 116.

The electric motor 118 and the gear train 120 are disposed on one side of the drive disk 116, on the opposite side of the rocker plate 4 from the force transmission rod.

The motor 118 drives the drive disk 116 through the gear train 120, which is a speed-reducing transmission. The gear train includes a free-wheel coupling device (not shown), one example of a practical embodiment of which is known from the document EP 1 408 522, and that enables the drive disk 116 to rotate rapidly during a switching operation without driving the motor.

The drive disk 116 also has a retractable section (not shown) that enables the motor 118 to be uncoupled from the drive disk 116 as soon as the drive disk 116 has passed the top dead center point of the closing spring 114. The top dead center point is the fully-loaded position of the closing spring 114.

The retractable section is for example the same as is disclosed in the document EP 1 369 886.

Operation takes place as follows.

The disconnector (circuit breaker) is closed, driven by the closing spring 114 through the drive disk 116, closing cam 102 and rocker plate 4. The drive disk 116 turns until its inertia is stored in the closing spring 114. The motor 118 is started earlier.

The free-wheel coupling device couples the drive disk and motor together as soon as the speed of rotation of the drive disk has diminished so as to reach the speed of the motor 118 as reduced by the gear train. The motor drives the drive disk 116 to the top dead center point of the closing spring 114. Beyond this top dead center point, the closing spring 114 drives the drive disk 116 until it is stopped by the open switch lock 600. The motor and gear train are then uncoupled from the wheel 116 by the retractable section. The motor 118 is stopped by the interrupter 124, triggered by the lever 126, the position of which is controlled by the profile of the disk 130.

This example of how the drive disk 116 is driven in rotation is in no way limiting, and any other driving means may be suitable. For example, the spring 114, motor 118 and gear train 120 can be replaced by a hydraulic or pneumatic system or by an electric motor connected to the actuator 100.

The actuator 100 also includes means 122 for de-energizing or energizing the motor, and for controlling the load of the closing spring 114.

Such means 122 comprise an interrupter 124 which is adapted to interrupt the power supply to the motor when the closing spring 114 has been loaded (loaded) by the required amount.

The interrupter 124 is coupled to a lever 126 via a transmission bar 128, the lever 126 being driven in rotation when the required energy has been reached.

The lever 126 is mounted rotatably on the mounting plate 2 and is adapted to make contact with an angular zone 130.1 of a control wheel 130 which lies on the same axis as, and rotatable with, the drive disk 116. The angular zone 130.1 constitutes a notch, extending radially inwards from the outer periphery of the control wheel 130.

The lever 126 can then occupy two positions, namely a first position in which a free end 126.1 of the lever is in contact with a circular periphery of the control wheel 130 (shown in broken lines in FIG. 1A), and a second position in which the free end 126.1 of the lever penetrates into the notch 130.1 (as shown in full lines in FIG. 1A).

When the lever 126 is in its first position, the interrupter 124 is closed, the electric motor 118 is energized, and the drive disk 116 is therefore set in rotation, thereby causing the closing spring 114 to be loaded.

When the lever 126 is in its second position, the interrupter 126 is open, the electric motor 118 is not under power, and the drive disk 116 is held stationary against the open switch locking device 600, the closing spring 114 is in its loaded or loaded state, and the motor and gear train are able to terminate rotating by inertia, without acting on the disk 116, because of the retractable toothed segment.

The lever 126 is biased elastically into contact with the control wheel 130 by a torsion spring 132.

The control wheel is preferably so dimensioned as to constitute an inertia mass or flywheel.

A visual indicator 134 for indicating the spring load (the amount of load in the spring) is also provided, being in the form of a disk that is coupled in rotation to the lever 126. This disk can be seen from outside. The disk 134 has visual markings corresponding to the loaded or disloaded state of the spring 114.

The closing actuator 100 has the advantage of a reliable and robust construction.

Moreover, it combines the means for loading the spring 114, the inertia mass that enables the time and speed of closing of the contactor to be controlled, the control means for the electric motor for loading the closing spring 114, and the control of a visual load indicator for the closing spring 114.

The opening actuator 400 includes means for storing elastic energy. These means consist of a helical spring 402, referred to as the opening spring, which is mounted rotatably at a first end 402.1 thereof on the mounting plate 2, and at a second end 402.2 on the rocker plate 2 at the corner 12.2.

The opening spring 402 is a tension spring.

Damping means 500 are advantageously provided inside the helical spring 402, and are also fixed to the rocker plate 4 at the corner 12.2.

The said damping means, or brake, 500 is designed to damp out the motion of the rocker plate when the opening spring 402 is causing the rocker plate 4 to tilt in the direction corresponding to opening of the contactor. Dampers of this kind are well known to the person familiar with this technical field, are known for example from the document EP 1 130 610, and need not be described in any detail here.

The first end 402.1 of the opening spring 402 is advantageously fixed as low down as possible on the mounting plate 2, remote from the rocker plate 4 and on the opposite side of the rocker plate 4 from the opening cam 102.

The opening spring/brake 402 is preferably inclined by an angle of about 45° relative to the vertical, upwardly and to the right in FIG. 1A.

When the elastic energy stored by the opening spring 402 is released, the rocker plate 4 is driven in the clockwise direction, so causing the contactor to open.

In the example shown, the opening spring 402 is a tension spring which is loaded during the closing phase of the contactor by tilting of the rocker plate 4 in the anti-clockwise direction. This tilting action gives rise to a tensile force at the second end 402.2 of the opening spring 402.

The distance between the axis of the main shaft 6 and the axis of the closing shaft 104 is equal to the maximum diameter of the cam plus the radius of the main shaft 6, with a tolerance of +30% of the maximum radius of the cam.

Careful choice of the distance between various elements of the operating mechanism sometimes enables its compactness to be increased, by reducing the amount of unoccupied intermediate spaces.

Figure 4D:
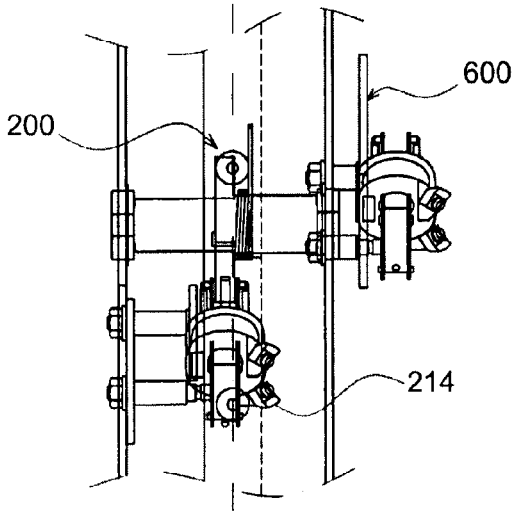
FIG. 4D is a side view of the two locking means shown in FIGS. 4A and 4B.
Figure 4A:
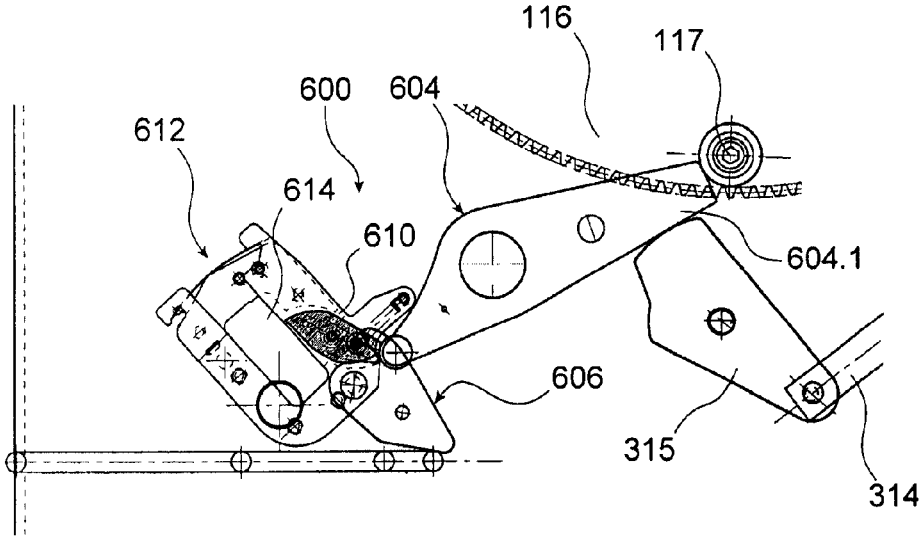
FIG. 4A is an enlarged view from the part of FIG. 1A that shows the open switch locking means, in order to explain the cooperation between the open switch locking means and the drive disk.
Figure 4B:
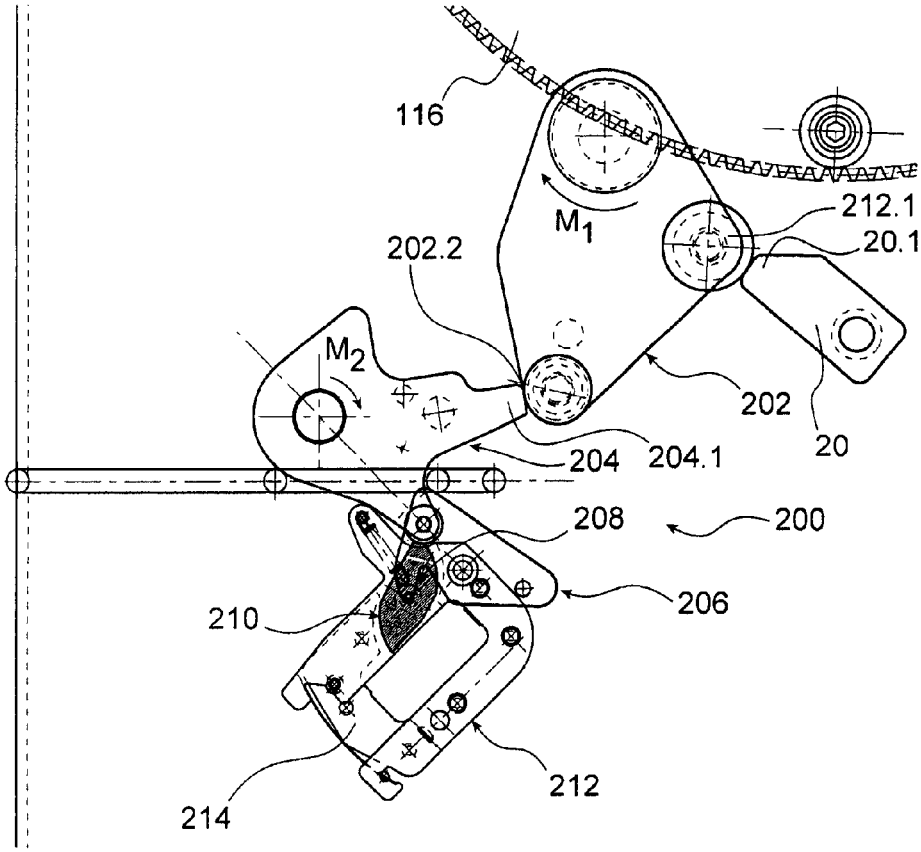
FIG. 4B is an enlarged view from the part of FIG. 1A that shows the closed switch locking means, in order to explain the cooperation between the closed switch locking means and the rocker plate.

FIGS. 4A and 4B show in detail the closed switch locking means 200 that act on the rocker plate 4 at the corner 12.5, and the open switch locking means 600 that act directly on the drive disk 116. The locking means 200 and 600 are interposed between the opening spring 402 and the loading means for the closing spring 114.

The locking means 200 are designed to hold the rocker plate 4 stationary in a closed position of the contactor, against the force applied by the opening spring 402 that tends to cause the rocker plate 4 to tilt in the direction corresponding to opening of the contactor.

The closed switch locking means 200 are such that they enable the rocker plate 4 to be held stationary, the rocker plate being subjected to a high torque, by converting this torque into a weaker torque. The closed switch locking means 200 are disposed between the two mounting plates 2, since they are in direct cooperation with the lever 20 that is fixed to the rocker plate 4.

In the example shown, the closing switch locking means 200 include a system of levers coupled in series, in engagement at one end on the operating lever 20 that is mounted rotatably on the rocker plate 4 at the corner 12.5.

The locking means 200 include a first lever 202 that is mounted rotatably on the mounting plate 2 and that is arranged to make contact at one end, 202.1, with an end 20.1 of the operating lever 20. The opening spring 402 exerts a force on the rocker plate 4 in the clockwise direction, and the rocker plate then passes to the operating lever 20 a force that it transmits on to the first lever 202, the direction of application of which does not pass through the axis of rotation of the first lever 202, and a torque M1 is thereby generated.

The locking mean 200 include a second lever 204 that is mounted rotatably in the mounting plate 2, to which the first lever 202 applies a force, thorough an end 202.2 thereof, on an end 204.1 of the lever 204, in a direction that does not pass through the axis of rotation of the second lever 204, so that a torque M2 is generated.

The torque exerted on the second lever 204, which tends to make it pivot clockwise, is taken up by a pawl 210 that is held stationary and that constitutes a mechanical abutment, this pawl being arranged to be displaced by electrical control means 212.

The locking means also include a third lever 206 that is mounted rotatably on the mounting plate and that is arranged for direct cooperation with the pawl 210, for manual locking, which is done by means of a lever that is described below.

The electrical control means 212 comprise at least one electromagnet 214 that is arranged to displace the pawl 210, thereby releasing the second lever 204 so that the lever 204 rotates clockwise, so causing the contactor to open.

Return means of the torsion spring type are also provided on each of the levers 202, 204 and 206, and on the pawl 210, for biasing them into their locking positions.

Rollers are preferably provided on the levers, at their ends that make contact, in order to reduce friction.

The operating lever 20 carried by the rocker plate 4 is also positioned, by a spring 24. Thus, when the rocker plate 4 is able to regain its initial position during a switch closing operation, it is locked in position by the closed switch locking means 200.

The electrical control means 212 are operated when the need to open the contactor is detected.

The manual opening means are described below.

In the practice of the present invention, the closed switch locking means 200 are disposed below the electric motor 118 and below the drive wheel 116, to one side of the rocker plate 4.

Figure 4C:
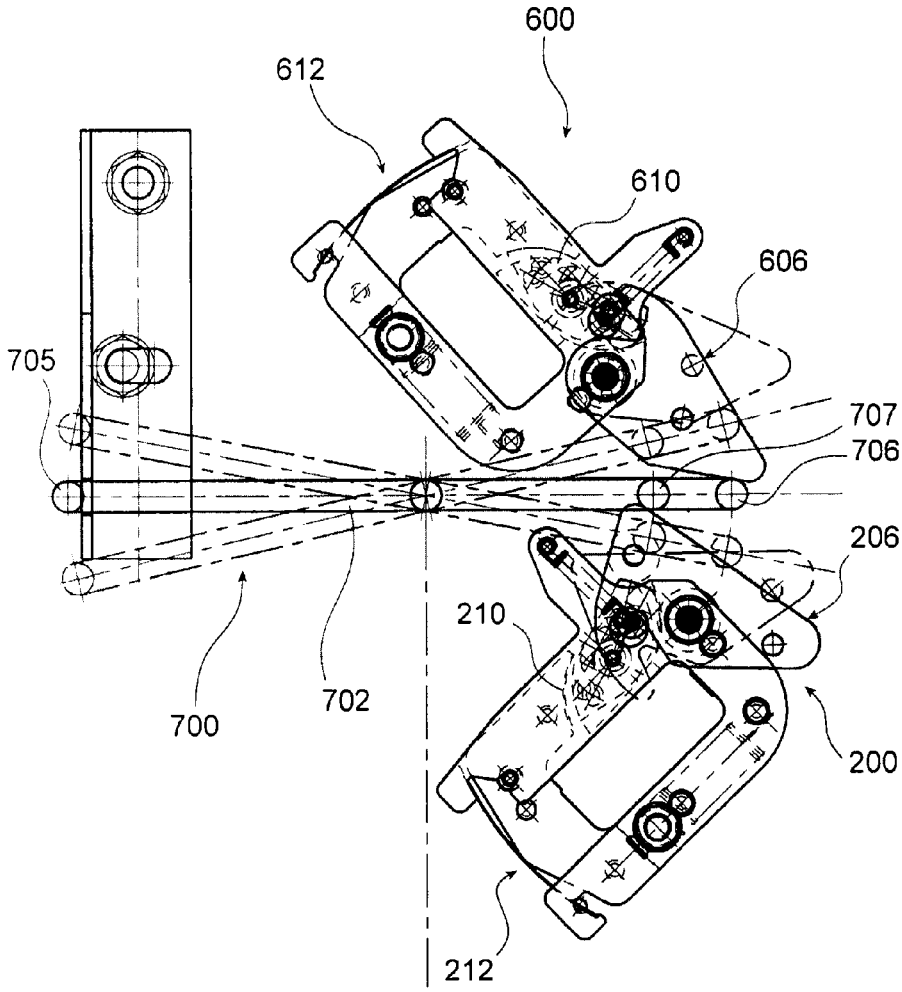
FIG. 4C is an enlarged view taken from part of FIG. 1A and shows the closed switch locking means and the open switch locking means in cooperation with manual actuating means.

Open switch locking means 600, shown in FIGS. 4A and 4C, are also provided, and are arranged to hold stationary the drive disk 116 against the force exerted by the closing spring 114 that tends to cause the rocker plate 114 to tilt in the direction corresponding to closing of the contactor. These components are disposed, in the example shown, above the closed switch locking means 200.

The open switch locking means 600 comprise, in a similar way to the closed switch locking means 200, a system of levers for repeating the torque exerted by the closing spring 114 on the drive disk 116, by means of a pawl (not shown) that is held stationary by electrical control means relative to the mounting plate 2.

The open switch locking means 600 are mounted on the mounting plate 2, on the opposite face of the mounting plate from the face on which the closed switch locking means 200 are arranged.

The lever system comprises a first lever 604 for receiving a force from the drive disk 116, the first lever 604 being in contact, through one of its ends, 6.4.1, with a roller 117 that is pivotable on the radially outer periphery of the drive disk 116.

The force exerted by the closing spring 114 tends to rotate the drive disk 116. This force is applied to the first lever 604 in a direction that does not pass through its axis of rotation, so that a torque is generated. This torque tends to cause pivoting movement of the first lever 604.

The torque is taken up by a pawl that is held stationary and that constitutes a mechanical abutment, being arranged to be displaced by an electrical control means 612.

The open switch locking means 600 also include a second lever 606 that is mounted rotatably on the mounting plate and that is arranged to cooperate directly with the pawl 610, for manual unlocking that is described below.

The electrical control means 612 comprise at least one electromagnet 614 that is adapted to displace the pawl so as to release the first lever 604, which thereupon rotates, so releasing the drive disk 116 that accordingly drives the rocker plate in an anti-clockwise direction, thereby causing the contactor to close.

Return means of the torsion spring type are also arranged on each of the levers 604 and 606, for biasing them towards the locking position.

A roller is also preferably provided on the ends of the lever that make contact, to reduce friction.

In the practice of the present invention, the open switch locking means 600 are disposed between the electric motor 118 and the closed switch locking means 200.

Moreover, the open switch locking means 600 are so disposed that they can act on the drive disk 116, and are situated in an orbital position relative to the axis of rotation of the drive disk 116, which arrangement offers some freedom of choice as to where to position the locking means.

The rocker plate is coupled at its corner 12.1 to a status indicating means 300, for showing various positions assumed by the switch.

The indicating means 300 comprise electrical position indicating interrupters 302 (only one of which is shown in FIG. 4A, for clarity), disposed below the rocker plate 4, a visual position indicator 308 in the form of a disk disposed between the interrupters 302 and the opening spring 402, and means for blocking the open switch locking function.

The interrupters 302 are controlled by the rocker plate 4 through a connecting rod 304. Several interrupters 302, for example four, are provided, and are ganged together by a bar connecting the four interrupters together, this bar being itself coupled to the connecting rod 304.

The visual indicator 308 is in the form of a disk that is arranged to be driven in rotation by a connecting rod 312 that is freely pivoted on the disk 308 and on the rocker plate 4. Thus, tilting movement of the rocker plate 4 causes the disk 308 to be displaced circumferentially (angularly).

The status indicator 300 includes a rod 314 for controlling the movement of the open switch locking lever 604 by means of the stop lever 315. The lever 604 is blocked, and is unable to release a switch closing operation if the switch is not fully open.

Manual actuating means 700 for the locking means 200 and 600 are also provided.

Of particular advantage is the fact that the manual actuating means 700 acts uniquely (i.e. independently) on each of the two locking means 200 and 600. The locking means include a lever 702, which is shown in full lines in its rest position.

Figure 4E:
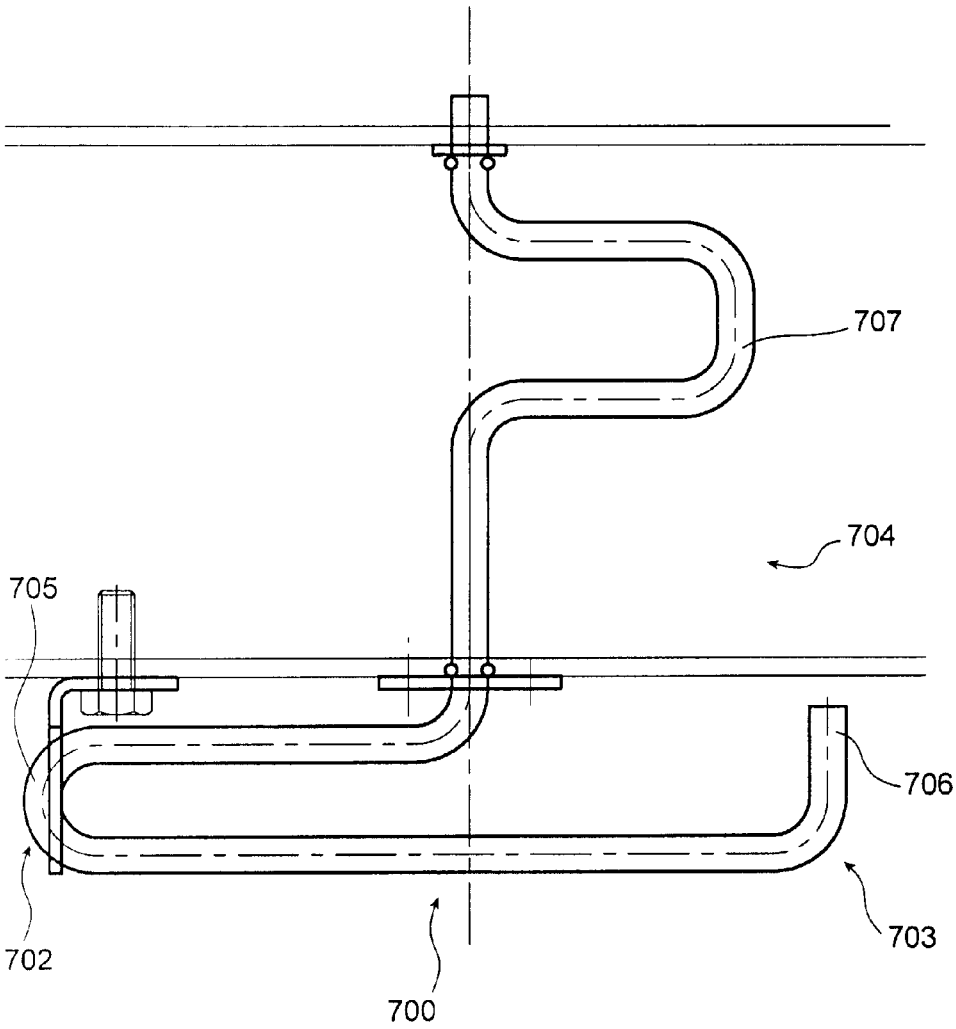
FIG. 4E is a top plan view showing, by itself, an actuating lever in the actuating means shown in FIG. 4C.
Figure 5:
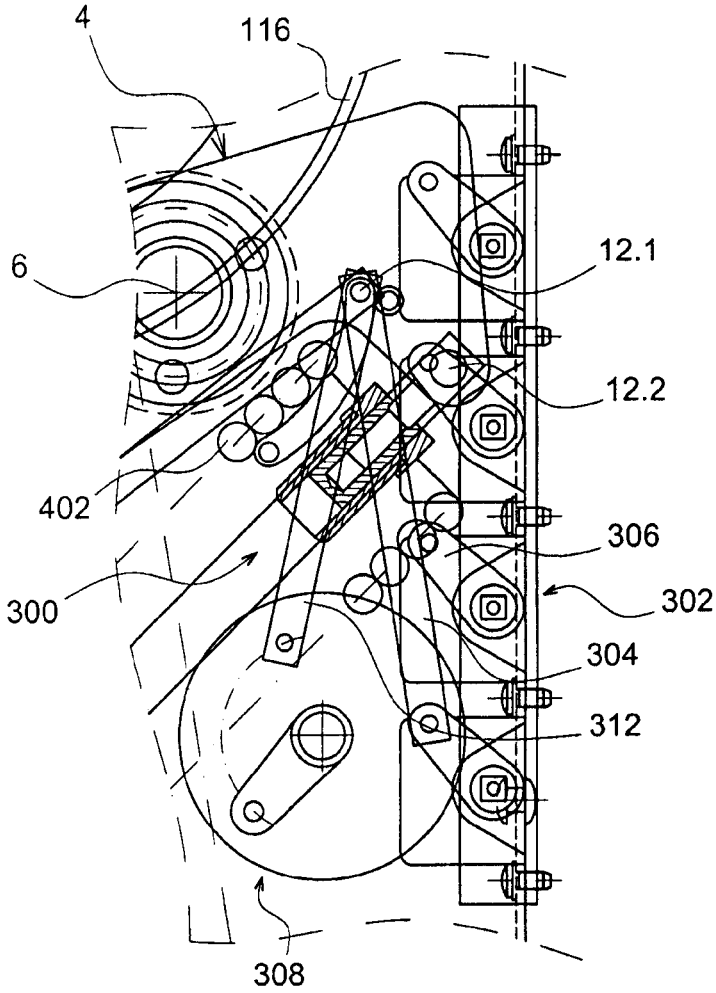
FIG. 5 is an enlarged detail view taken from the part of FIG. 1A that shows optical and electrical means for indicating the switch positions.

One version of the lever 702 is shown by way of example in the view from above in FIG. 4E, from which the closed and open switch locking means themselves are omitted for clarity.

The lever 702 is mounted for free rotation between the mounting plates 2 and between the two locking means 200 and 600.

The lever 702 consists of a first portion 703 that is arranged to be outside the mounting plates 2, and a second portion 704 arranged to be inside the mounting plates 2.

The first portion 703 lies parallel to the mounting plate 2 and has a first end 705 that acts as a handle for manual operation, and a second end 706 for cooperation with the open switch locking means 600 when the means 600 is operated by hand.

The first end 705 is extended by the second portion 704, which lies substantially along the axis of rotation of the lever 702, and includes a U-shaped radial projecting element 707 for cooperating with the closed switch locking means 200 when the means 200 is operated by hand.

When the operator pivots the lever 702 clockwise (to the position shown at A in broken lines), by raising the first end 705, the element 707 of the second portion 704 comes into engagement against the lever 206, the lever 206 makes contact with the pin 208 that projects from the pawl 210, and the pawl 210 pivots clockwise in a manner identical with electrical operation, so that the closed switch locking system is unlocked.

If the operator displaces the manual lever 702 in the clockwise direction (to the position shown at B in broken lines) by moving the first end 705 down, the second end 706 of the first portion 703 comes into engagement against the lever 606 and causes the pawl 610 to pivot clockwise, again in the same manner as for electrical operation.

The shape of the lever 702 permits interaction on the two planes that correspond to the closed switch locking system and the open switch locking system.

The manual actuating means have the advantage that they are of simple design and they act exclusively on whichever of the closed switch or the open switch locking means is selected, which enables the number of components in the operating mechanism to be reduced and therefore reduces the production cost.

In the practice of the present invention, the rocker plate 4, the cam 102, the opening spring 402 with integrated damping means 500, and the closed switch locking means 200, all lie in the same plane, and are so arranged that there is no interference between them when movement is taking place.

By means of be present invention, the operating mechanism is very compact and very robust, and has a reduced number of components.

Figure 6A:
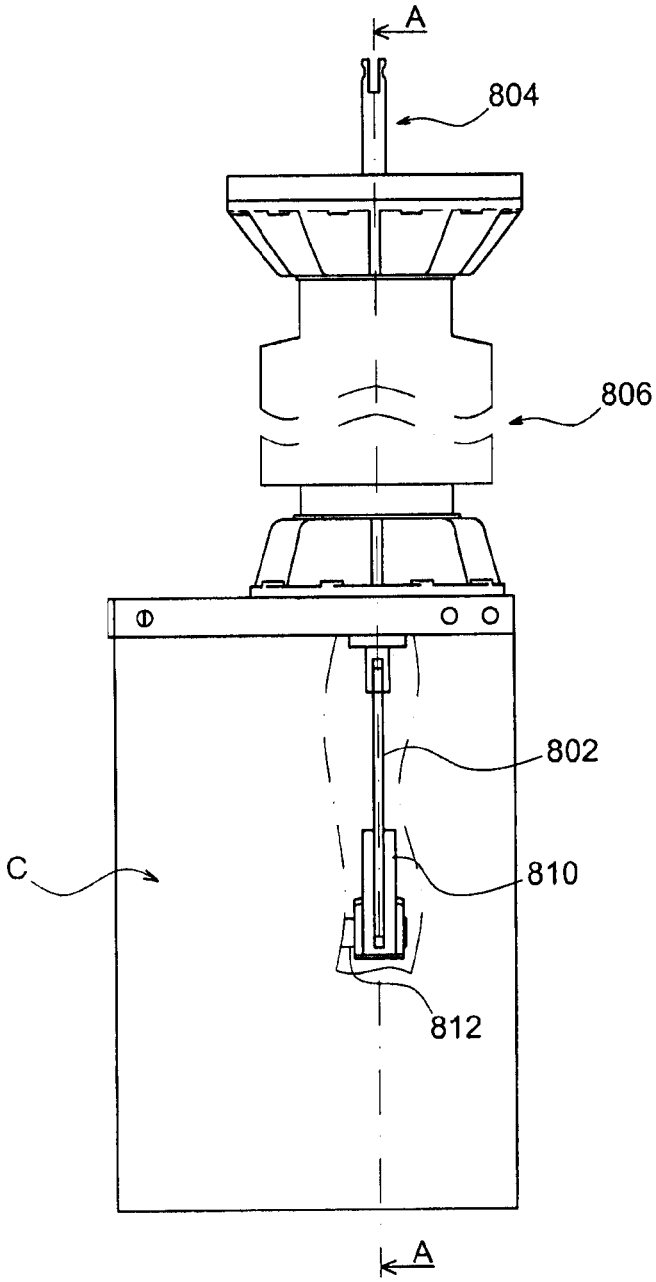
FIG. 6A is a side view of one embodiment of a unit of switchgear of the present invention.
Figure 6B:
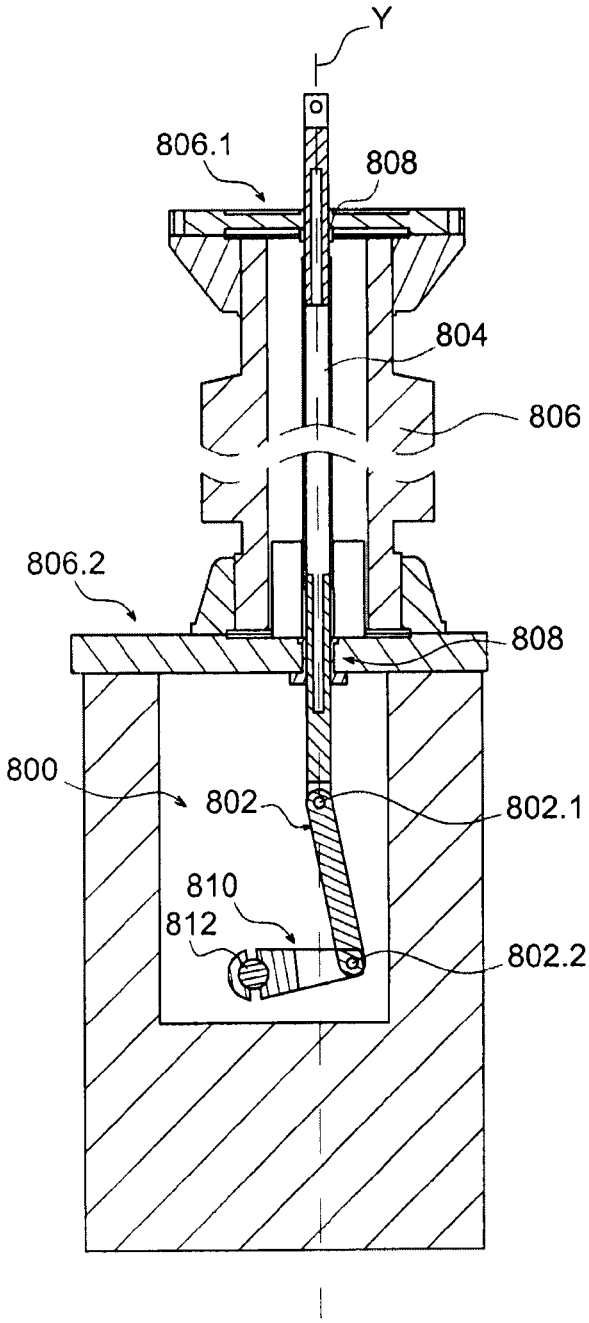
FIG. 6B is a view, in longitudinal section, taken on the plane A-A in FIG. 6A, of part of that switchgear unit.

FIGS. 6A and 6B show by way of example one version of a unit of switchgear (a switch) having means for actuating the contactor which are able to be mounted below the contactor, instead of at the side as is usual in switchgear in the current state of the art. These actuating means may, with advantage, be associated with the operating mechanism of the present invention.

In the example shown in FIGS. 6A and 6B, the actuating means 800 include an intermediate bar 802 which is rotatably coupled, at a first end 802.1 thereof, to an insulating rod 804 that is guided in straight line movement along an axis Y by an insulating support column or bushing 806.

An upper end of the insulating rod 804 is connected to one pole of the contactor (not shown), so that displacement of the insulating rod 804 in a straight line causes the pole to be displaced relative to another pole of the contactor, in a direction in which the poles are moved towards or away from each other and therefore in a direction corresponding to closing or opening of the contactor.

Guide sleeves 808 are also provided, advantageously, at an upper end 806.1 and a lower end 806.2 of the column 806.

The intermediate bar 802 is pivoted freely, at a second end 802.2 opposite to its first end 802.1, on a lever 810 that is fastened on a control shaft 812 for rotation with it.

The system consisting of the intermediate rod 802 and lever 810 constitutes a linkage for converting a rotary movement of the shaft into a straight line movement of the insulating rod.

These actuating means make it possible to eliminate parasitic forces and to have an output end of the connecting rod integrated in the operating mechanism, instead of having an output at the side of the switch.

Actuating means 800 are particularly well adapted for the operating mechanism C of the present invention shown in FIGS. 1A to 5, in which the shaft 812 is shaft 6, lever 810 is the lever 15, and the intermediate rod 802 is pivoted on the lever 15.

In addition, these actuating means 800 make it possible, instead of having to seal the whole of the switchgear unit, to provide sealing only at the level of the lower part 814 of the unit.

The actuating means 800 have the advantage that they have few moving parts, and, moreover, the moving parts are smaller in size. The actuating means are therefore very compact and economical of energy.

Moreover, the actuating means here described enable buckling of the insulating rod to be avoided: such buckling is caused by apparatus in the current state of the art applying compressive stresses. The rotational movement of the shaft 812 is converted simply into linear motion to be passed to the insulating rod 804.

Figure 7A:
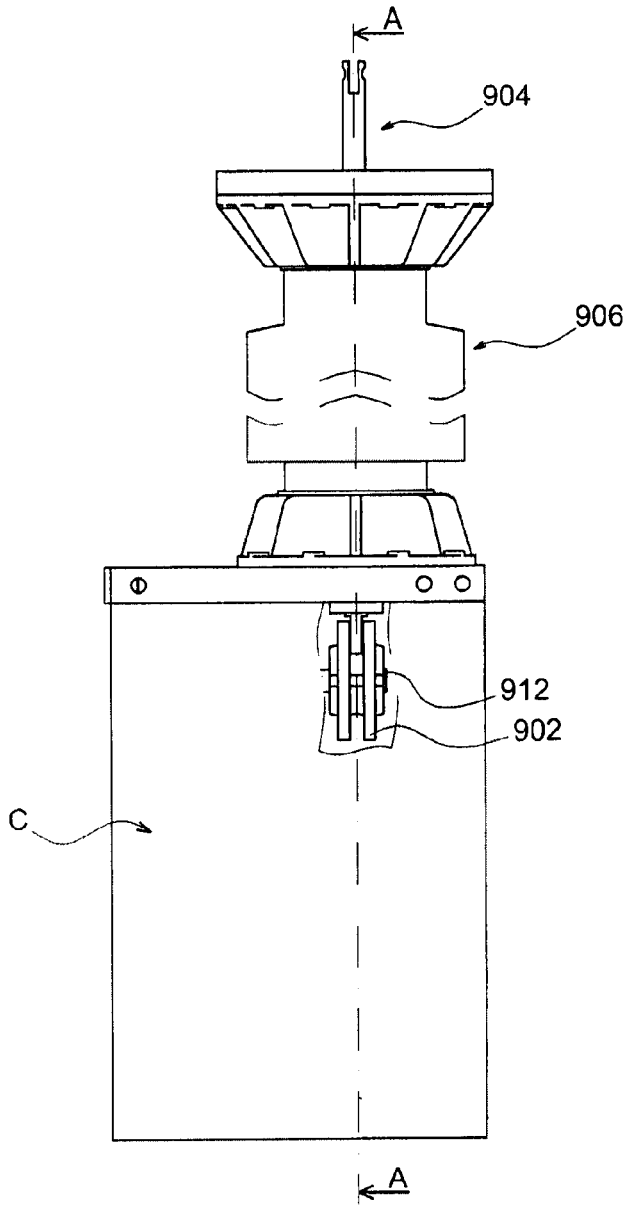
FIG. 7A is a front view, partly cut away, of an embodiment of a switchgear unit according to the present invention.
Figure 7B:
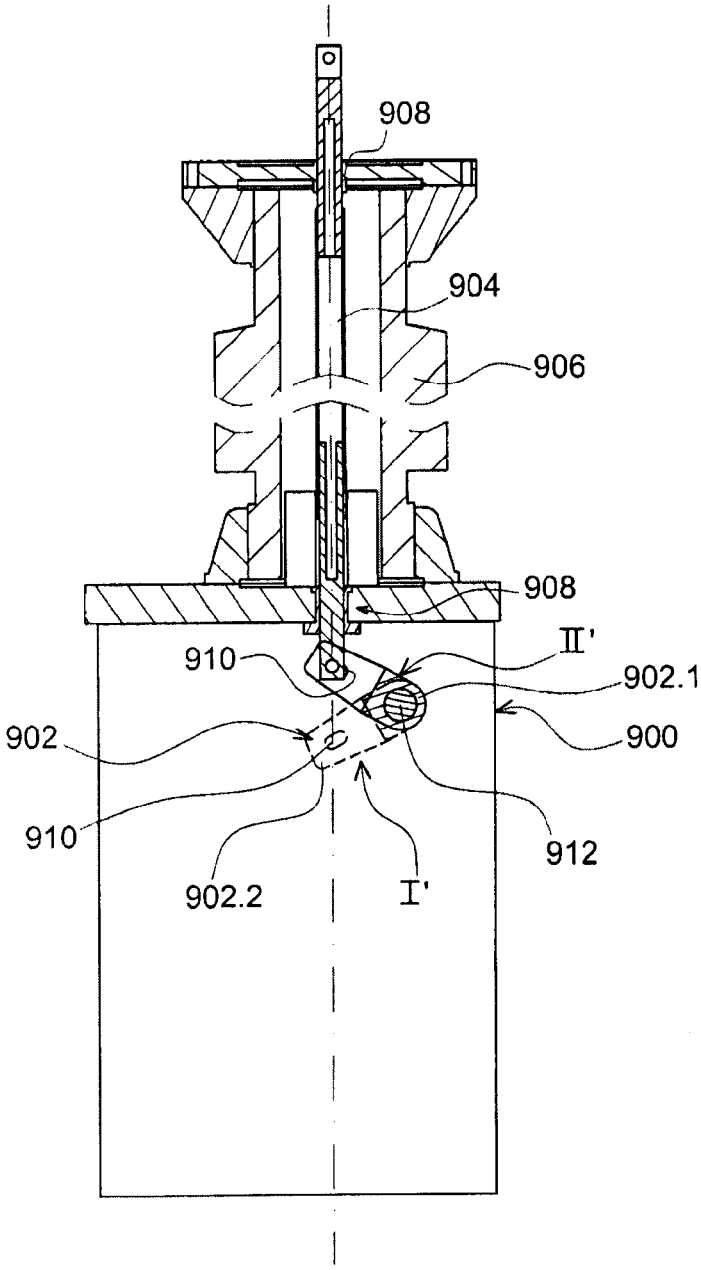
FIG. 7B is a view, in longitudinal section taken on the plane A-A in FIG. 7A, of the switchgear unit shown therein.

FIGS. 7A and 7B show by way of example a further version 900 of an actuating means for the contactor, in accordance with the present invention.

In a similar way to the switch seen in FIGS. 6A and 6B, an insulating rod 904 is mounted for sliding movement in a bushing or insulating support column 906, and is guided by sleeves 908 at the levels of the lower and upper ends of the bushing 906.

In this version, there is no intermediate rod, and the actuating means 900 include a lever 902 that is fixed at one end 902.1 on a shaft 912, while its second end 902.2 is pivoted on the lower end of the insulating rod 904.

The lever 902 is mounted on the insulating rod 904 with a clearance by virtue of an elongate slot 910, so as to avoid any transverse applied forces on the insulating rod 904.

The lever 902 is shown in two positions, namely a position I' in which the contactor is open, and a position II' in which the contactor is closed.

The actuating means 900 have the advantage that they consist of few moving parts, and moreover these are of small size. The actuating means are therefore very compact and economical of energy.

The actuating means 900 also offer the advantage of applying less compressive force to the insulating rod.

The actuating means 900 are also particularly well adapted to the operating mechanism C of the present invention as shown in FIGS. 1A to 5: in that configuration, the shaft 912 is the main shaft 6, and the lever 902 is represented by the lever 15, having an oblong slot at the free end 15.1 of the lever 15. In FIG. 6A the operating mechanism C is placed to the left of the actuating means 900.

Figure 8A:
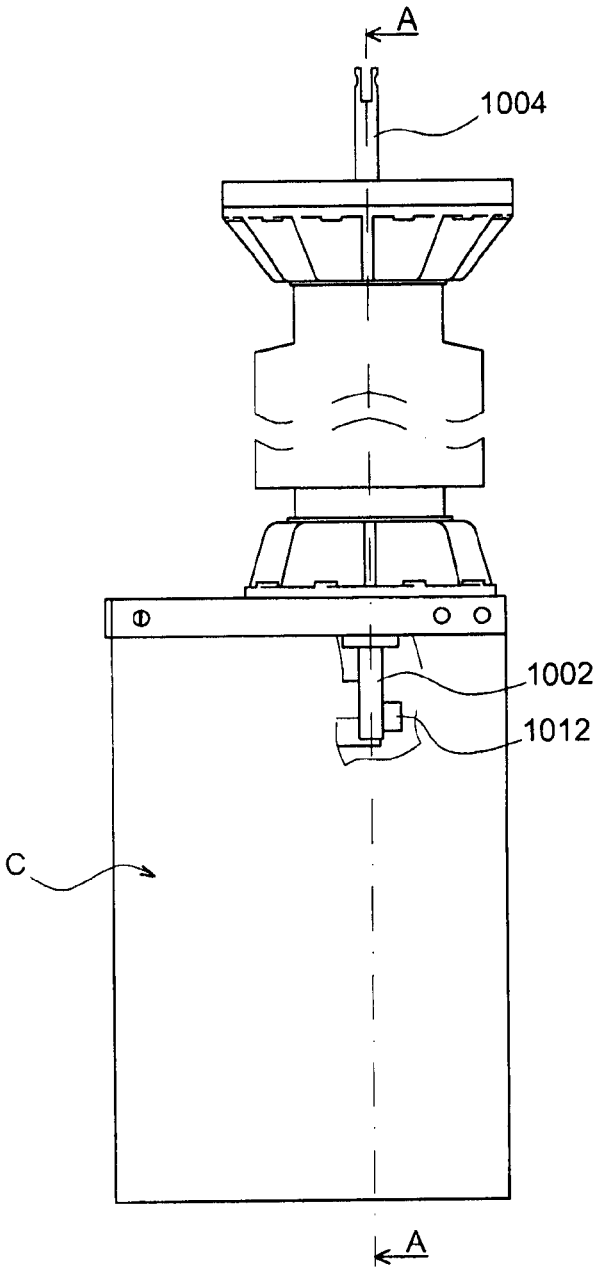
FIG. 8A is a front view, partly cut away, of a further embodiment of a switchgear unit according to the present invention.
Figure 8B:
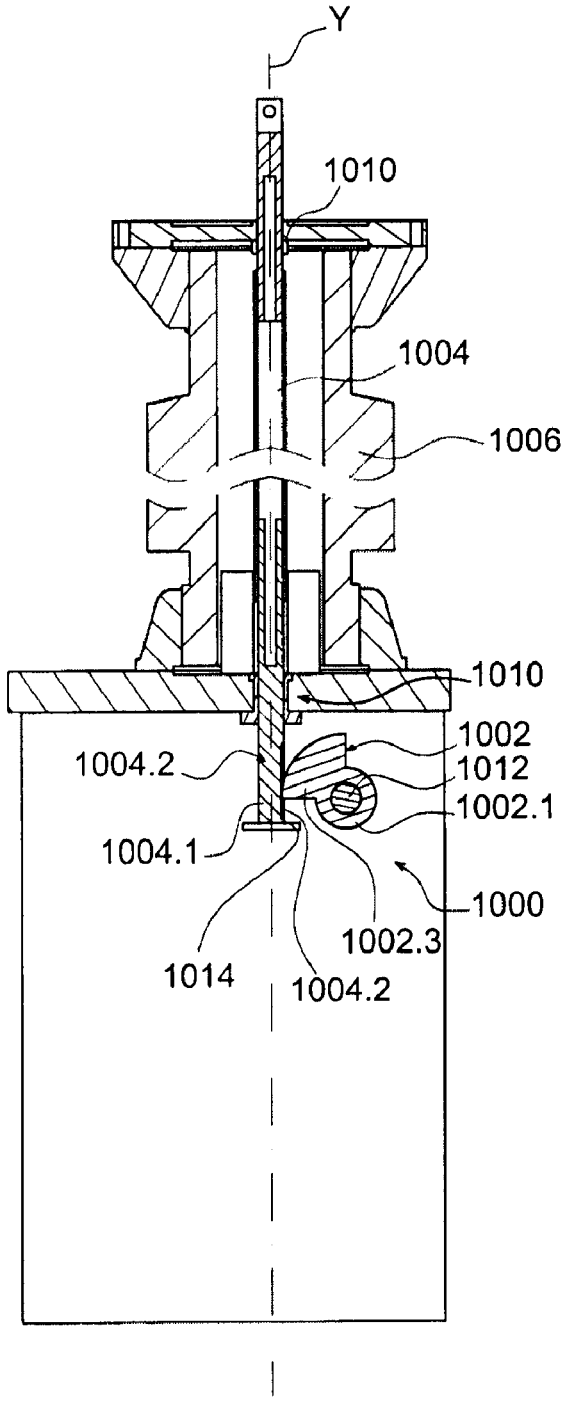
FIG. 8B is a view, in longitudinal section taken on the plane A-A in FIG. 8A, of part of the switchgear unit shown therein.

FIGS. 8A and 8B show by way of example a further version 1000 of an actuating means for the contactor, in accordance with the invention.

In a similar way to the switch of FIGS. 6A and 6B, an insulating rod 1004 is shown, which is arranged to slide in a bushing or insulating support column 1006, and is guided by sleeves 1010 at the level of the lower and upper ends of the bushing 1006.

In this version, there is no intermediate bar and the actuating means comprise a lever 1002 fixed, at a first end 1002.1 thereof, on a shaft 1012. The lever 1002 includes a toothed angular sector 1002.3 which is in mesh with a lower end 1004.1 of the insulating rod 1004 that has a corresponding set of teeth 1004.2.

An end stop 1014 is arranged at the lower end of the insulating rod 1004, to prevent the toothed sector from coming out of mesh with the toothed portion of the insulating rod.

Rotation of the lever 1002 thus causes the insulating rod 1004 to be displaced along the axis Y.

The actuating means 1000 have the advantage that they consist of few moving parts, and moreover the moving parts are of small size. The actuating means are therefore very compact and economical of energy.

The actuating means 900 also offer the advantage of applying less compressive force to the insulating rod.

The actuating means 1000 are, again, particularly well adapted to the operating mechanism C of the present invention as shown in FIGS. 1A to 5: the shaft 1012 is the main shaft 6, and the lever 1002 is represented by the lever 15 with a contour that includes a toothed sector. In FIG. 6A, the operating mechanism C is located to the left of the actuating means 1000. The toothed sector can with advantage be formed directly on the lever 15.

Figure 9:
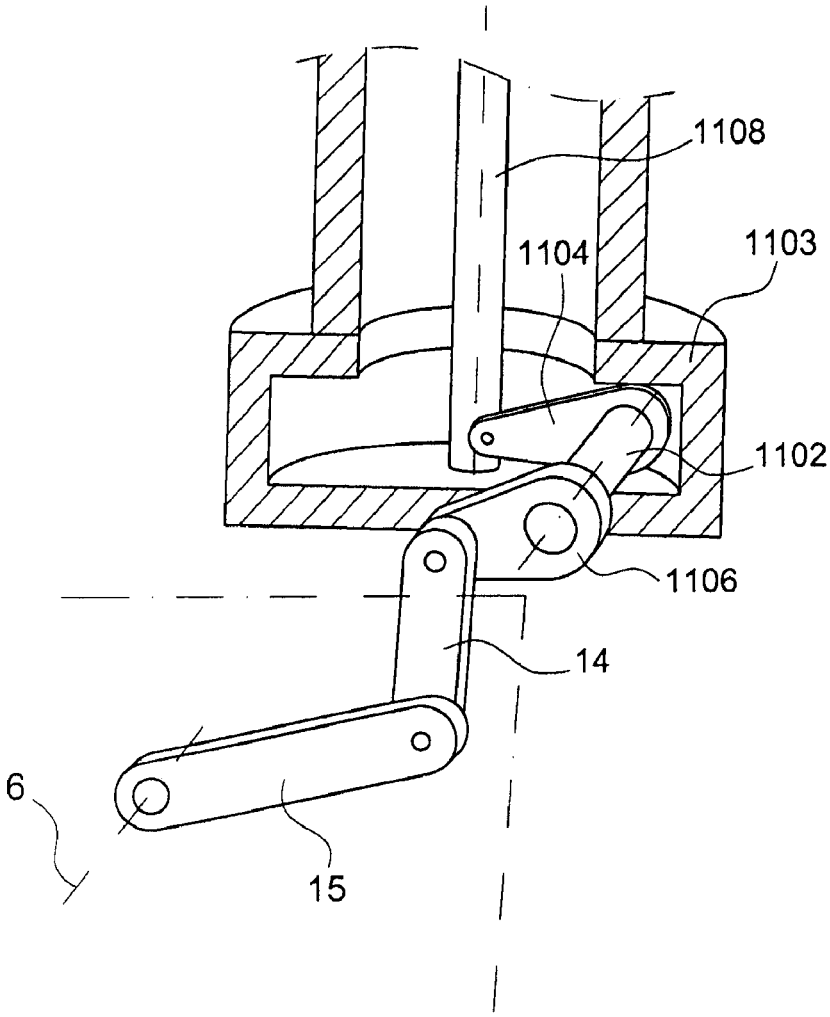
FIG. 9 is a diagrammatic perspective view, partly in longitudinal section, showing a detail in another embodiment of a switchgear unit according to the present invention.

It is also possible to envisage that the movement be guided in the disconnector by a rotary shaft 1102 constructed inside the bushing or insulating support column of the disconnector, as is shown diagrammatically in FIG. 9. The shaft 1102 extends, sealingly, substantially at a right angle, through a wall of the bushing, and is adapted to turn on its axis. The shaft 1102 has two levers 1104 and 1106, one at each of its ends. The lever 1104 is mounted inside the bushing 1103 and is coupled mechanically to the insulating rod 1108. The lever 1106, referred to as the outer lever, is disposed outside the bushing, and is coupled mechanically to a force transmission rod 14 coupled to the lever 15. The outer lever 106 converts the straight line motion of the rod 14 into rotation of the shaft 1102. The inner lever 1104 converts the rotation of the shaft 1102 into straight line motion of the insulating rod 1108. Sealing is easier to achieve in this version, because it is a rotatable shaft that is sealed and not a sliding rod.

In a modified embodiment, not shown, the main shaft 6 is on the same axis as the shaft 1102, and is coupled to this shaft for rotation with it, for example by means of a sleeve. Rotation of the main shaft thus causes rotation of the shaft 1102, and sliding movement of the movable contact. This version can be envisaged when the main shaft of the operating mechanism of the invention is able to be aligned with the control shaft of the switch. This version has the advantage of simplified construction.

The operation of the operating mechanism of the present invention is described below.

Figure 1B:
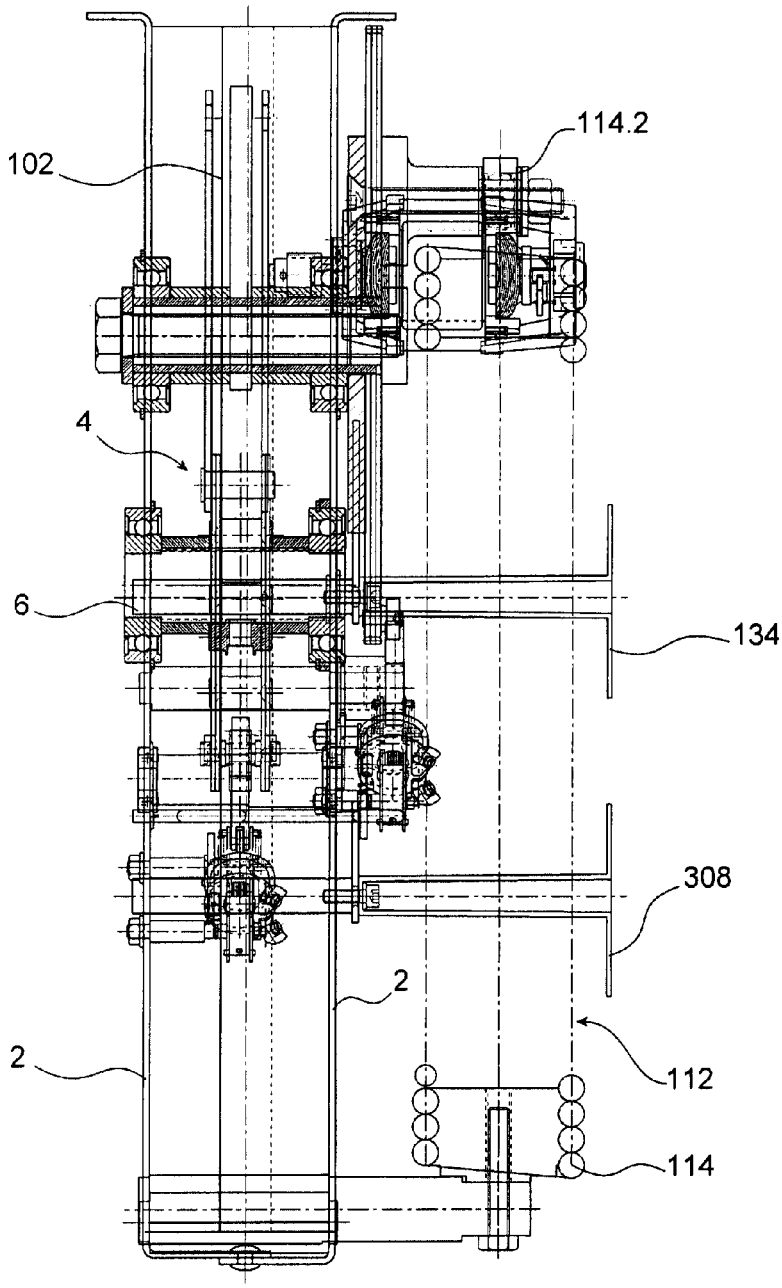
FIG. 1B is a side view of the operating mechanism shown in FIG. 1A.

The switch is supposed to be in its closed state, with the springs 402 and 114 charged (loaded), in the position shown in FIG. 1.

When an order to open the switch is given, the electrical control means 212 are activated, so causing the pawl 210 to be displaced, and the closed switch locking means 200 are then de-activated, so releasing the rocker plate 4, which is made to tilt clockwise by the opening spring 402.

When an order to close the switch is given, the electrical control means 612 are activated, so causing the pawl to be displaced and the lever 604 released so that it pivots. The drive disk 116 can then be rotated by the closing spring 114, carrying with it the closure cam 102. The closure cam 102 then comes into contact with the rocker plate 4 at the corner 12.4, so causing it to tilt in the anti-clockwise direction. The main shaft is driven in rotation, so causing the lever 15 to rotate so that it raises the rod 14, thereby closing the switch.

The anti-clockwise tilting movement also causes the opening spring 402 to be loaded, so that it is then ready for a new opening operation. The closed switch locking means 200 are also activated once again.

The loading of the closing spring 114 then takes place. In a first step, the inertia of rotation of the drive disk 116 is used for the partial loading of the closing spring 114. When the speed of rotation of the disk 116 has been reduced until it is the same as the speed of the gear train, the free wheel then assumes a blocking mode and the motor 118 drives the drive disk 116 in rotation, so completing the tensioning of the closing spring until it overruns the top dead center point of the closing spring 114. The indicator 134 shows the load of the closing spring 114, the motor 118 is stopped by switching of the interrupter 124, and the closing spring 114 continues the rotation of the drive disk 116.

Locking of the open switch then takes place automatically when the roller 117 engages on the open switch locking system 600.

When an order for opening the switch is given, the electrical control means 212 are activated, so causing the pawl 210 to be displaced and the lever 204, followed by the lever 202, to be released into pivoting movement. The rocker plate 4 is then able to turn clockwise under the action of the opening spring 402, driving with it the main shaft 6 and lever 15 (this is the example illustrated by FIG. 9), and the force transmission rod 14 is then displaced downwards, so causing the switch to open.

Opening and closing of the switch may also be controlled manually by operation of the lever 702 in the way already described.

An operating mechanism has thus been achieved that is compact, robust and of simple design. Moreover its cost is reduced as compared to operating mechanisms in the current state of the art.

The invention claimed is:

1. An operating mechanism for a switch in medium or high voltage switchgear, including a rocker plate fixed on a main shaft that is mounted for rotation on at least one first mounting plate said main shaft being orthogonal to the first mounting plate, and the rocker plate being orthogonal to the main shaft the main shaft being coupled to the switch, whereby opening and closing of the switch are caused to take place by rotation of the main shaft the main shaft being adapted to be rotated by tilting movement of said rocker plate and said operating mechanism further including:

a rotary closing actuator with a force transmitting means for closing the switch;

an opening actuator for opening the switch; and closed switch locking means for locking the switch in a closed state, said locking means being adapted to apply to the rocker plate a locking force to lock the rocker plate when the switch is in its closed state;

said rocker plate being linked to the opening actuator the rotary closing actuator being adapted to make contact with the rocker plate whereby to cause the rocker plate to pivot in a direction corresponding to closing of the switch, and the closed switch locking means being adapted to make contact with the rocker plate whereby to hold the switch closed; and the rocker plate, the opening actuator the force transmitting means of the closing actuator and the closed switch locking means being so disposed that the forces applied by the opening actuator the force transmitting means of the closing actuator, and the closed switch locking means are all substantially in one plane of the rocker plate, referred to as the first plane.

2. An operating mechanism according to claim 1 wherein the force transmitting means consists of a cam that is fixed on, and rotatable with, a closing shaft parallel to the main shaft the cam being adapted to make contact with a second zone of the rocker plate, whereby to apply a tilting force, in a first direction of rotation, to the rocker plate fixed to the main shaft so as to cause the switch to close, said cam being rotatable with a drive disk that is adapted to be driven in rotation by elastic energy storage means comprising a closing spring said closing spring being disposed in a second plane that is substantially parallel to the first plane, and said closing spring being rotatably mounted at a first end thereof on the first mounting plate and, at a second end of the spring, on the drive disk.

3. An operating mechanism according to claim 2 further including open switch locking means adapted to exert a force holding the drive disk stationary when the closing spring is in a loaded state.

4. An operating mechanism according to claim 3 wherein the means for loading the closing spring comprise a train of toothed wheels driven by an electric motor, with one said toothed wheel meshing with teeth on the periphery of the drive disk and wherein the drive disk, the toothed wheel meshing with the drive disk, and the open switch locking means are disposed substantially in a common third plane parallel to the first plane.

5. An operating mechanism according to claim 2 wherein the closing spring overlies the rocker plate.

6. An operating mechanism according to claim 2 wherein the opening actuator includes an opening spring that is adapted to urge the rocker plate in a second direction of rotation opposed to the first direction of rotation, whereby to cause said switch to be opened, the opening spring being mounted on the same face of the first mounting plate as the rocker plate the closing spring being disposed on another face of the first mounting plate the opening spring having a first end rotatably mounted on the first mounting plate, on the same side of the mounting plate as the first end of the closing spring relative to the rocker plate, and the opening spring further having a second end rotatably mounted on the rocker plate.

7. An operating mechanism according to claim 6 wherein the closing spring crosses over the opening spring.

8. An operating mechanism according to claim 6 wherein the closing shaft lies on the opposite side, relative to an axis which is substantially parallel to the axis of the opening spring and which intersects the main shaft from the opening spring.

9. An operating mechanism according to claim 7 wherein the closing shaft lies on the opposite side, relative to an axis which is substantially parallel to the axis of the opening spring and which intersects the main shaft from the opening spring.

10. An operating mechanism according to claim 2 wherein the closed switch locking means cooperates with an operating lever which is rotatably mounted on the rocker plate.

11. An operating mechanism according to claim 2, further including open switch locking means adapted to exert a force holding the drive disk stationary when the closing spring is in a loaded state, and including manual actuating means adapted to release, alternately, the open switch locking means and the closed switch locking means so as to enable the switch to be closed and opened respectively, said manual actuating means comprise an actuating lever rotatably mounted on the first mounting plate and disposed between the closed switch locking means and the open switch locking means.

12. An operating mechanism according to claim 11 wherein the actuating lever is adapted to be operated at a first end thereof, and is arranged to make contact through an end of the actuating lever with a lever of the open switch locking means and through another end of the actuating lever with a lever of the closed switch locking means so as to cause said levers to tilt whereby to release switch closing energy and switch opening energy respectively.

13. An operating mechanism according to claim 12 wherein said actuating lever consists of a first portion and a second portion the first portion including a second end which is the end for cooperation with said lever for de-activating the open switch locking means and the second portion including a radial projecting element which is the end for cooperation with said lever for de-activating the closed switch locking means.

14. An operating mechanism according to claim 2 further including open switch locking means adapted to exert a force holding the drive disk stationary when the closing spring is in a loaded state, and wherein the closed switch locking means and the open switch locking means are mounted on either side of the first mounting plate.

15. An operating mechanism according to claim 2 wherein the rocker plate is disposed in at least two parallel planes.

16. Medium and high voltage switchgear including a switch having a contact or pole movable in a straight line and a fixed pole, and further including an operating mechanism according to claim 2.

17. Switchgear according to claim 16 wherein the switch includes a shaft rotatable about its axis and a switch actuating lever rotatable with said shaft, the switch actuating lever being coupled to said movable contact in such a way that a rotational movement of said shaft about its axis causes said movable contact to be displaced in a straight line, and wherein the main shaft and the shaft of the switch are on the same axis as each other and rotatable together.

18. Switchgear according to claim 16 wherein a switch actuating lever is rotatable with the main shaft and fixed to the main shaft where the main shaft projects from one of the mounting plates, the switch actuating lever being coupled to the movable contact.

19. Switchgear according to claim 18 further including a link rod system for coupling the switch actuating lever to the movable contact of the switch.

20. Switchgear according to claim 18 wherein the switch actuating lever has an oblong slot in which one end of an element rigidly coupled to the movable pole of the switch is arranged to be loosely mounted.

21. Switchgear according to claim 18 wherein the switch actuating lever includes a toothed angular sector adapted to mesh with a toothed portion that is rigidly coupled to the movable pole of the switch.

* * * * *